United States Patent [19]

Shimoi

[11] 4,098,070

[45] Jul. 4, 1978

[54] DIGITAL DISPLAY ELECTRONIC WRISTWATCH

[75] Inventor: Akio Shimoi, Suwa, Japan

[73] Assignee: Kabushiki Kaisha Suwa Seikosha, Tokyo, Japan

[21] Appl. No.: 648,081

[22] Filed: Jan. 12, 1976

[30] Foreign Application Priority Data

Jan. 13, 1975 [JP] Japan ..... 50-6068

[51] Int. Cl.[2] ..... G04C 3/00

[52] U.S. Cl. ..... 58/23 R; 58/85.5

[58] Field of Search ..... 58/23 R, 23 AC, 23 TF, 58/85.5; 310/8 R, 8.5; 331/116 R

[56] References Cited

U.S. PATENT DOCUMENTS

| | | | |
|---|---|---|---|
| 3,143,672 | 8/1964 | Mason | 310/8.5 |
| 3,471,721 | 10/1969 | Moore | 310/8.5 |
| 3,774,057 | 11/1973 | Tsubouchi | 310/9.5 |
| 3,777,471 | 12/1973 | Koehler et al. | 58/23 R |
| 3,791,133 | 2/1974 | Hashimura et al. | 58/23AC |
| 3,812,670 | 5/1974 | Nikaido et al. | 58/23 R |
| 3,895,486 | 7/1975 | Hammer et al. | 58/23 R |
| 3,904,489 | 9/1975 | Guntersdorfer | 310/8.5 |
| 3,914,931 | 10/1975 | Tsuruishi | 58/23 R |
| 3,922,844 | 12/1975 | Sakamoto | 58/23 R |
| 3,978,649 | 9/1976 | Naito | 58/23 R |
| 3,988,621 | 10/1976 | Nakayama et al. | 310/9.4 |
| 4,004,407 | 1/1977 | Fujita | 58/23 R |
| 4,020,626 | 5/1977 | Kawabara et al. | 58/23 R |

*Primary Examiner*—Robert K. Schaefer
*Assistant Examiner*—Vit N. Miska
*Attorney, Agent, or Firm*—Blum, Moscovitz, Friedman & Kaplan

[57] ABSTRACT

A digital display electronic wristwatch including a quartz crystal high frequency time standard having a natural frequency in the MHz range is provided. The quartz crystal time standard is incorporated into an oscillator circuit that produces a high frequency time standard signal having the same frequency as the frequency of vibration of the time standard. A divider circuit is formed from a plurality of series-connected divider stages and produces a low frequency reference signal in response to the time standard signal. Series-connected counters are coupled to the divider to produce time-keeping signals in response to the low frequency reference signal being applied thereto, and digital display elements are adapted to display time in response to the time-keeping signals produced by the respective series-connected counters.

9 Claims, 6 Drawing Figures

FIG. 3
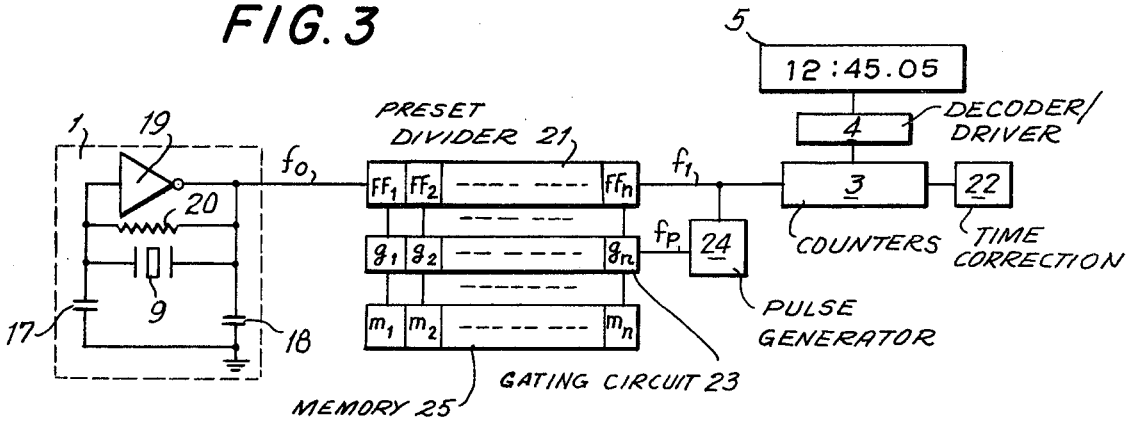
FIG. 5
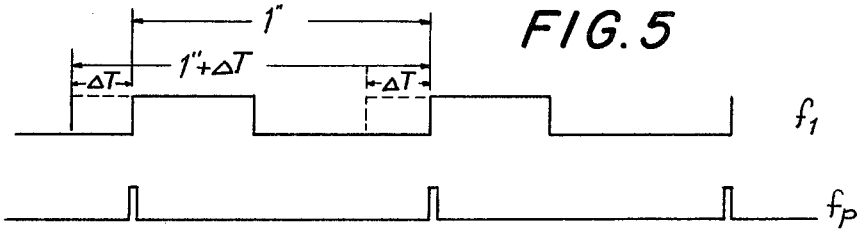
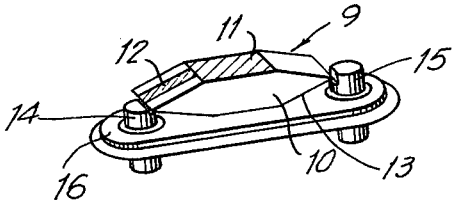
FIG. 4
FIG. 6
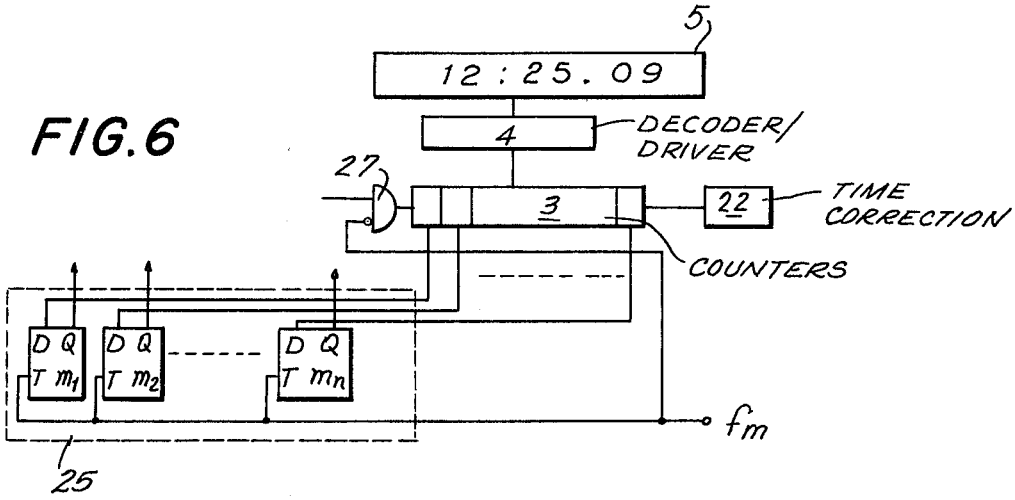

DIGITAL DISPLAY ELECTRONIC WRISTWATCH

BACKGROUND OF THE INVENTION

This invention is directed to a digital display electronic wristwatch utilizing a quartz crystal time standard capable of vibrating in the MHz range and in particular to the use of the thickness-shear quartz crystal vibrator having a frequency of vibration of at least one MHz as a time standard in a digital display electronic wristwatch.

The development of digital display technology has paralleled the rapid advance in small-sized electronic wristwatches of extremely high accuracy. When combined, such digital display electronic wristwatches have been able to provide numerous functions heretofore unavailable in electro-mechanical wristwatches. For example, the use of digital displays in electronic wristwatches has enabled same to be utilized as stopwatches for measuring periods of elapsed time to a one-hundredth and one-thousandth of a second degree of accuracy. Clearly, such degrees of accuracy would not be obtainable with a mechanical display electronic timepiece. Also, digital displays have permitted the display of temperature information, humidity information and basal body temperature.

Chronographic wristwatches having stopwatch capabilities have been rapidly developed to take advantage of the high accuracy afforded by quartz crystal time standards. Nevertheless, the accuracy of such electronic timepieces has been less than completely satisfactory, due in large measure to the inability to effectively and accurately adjust the timing rate grade, i.e., the frequency of the low frequency timing signals produced by the divider in response to the high frequency time standard signal applied to the divider.

SUMMARY OF THE INVENTION

In accordance with the instant invention, a digital display electronic timpiece utilizing a quartz crystal time standard having a frequency of vibration in the MHz range is provided. The time standard is a thickness-shear quartz crystal vibrator and is utilized in an oscillator circuit to produce a high frequency time standard signal having a frequency equal to the frequency of vibration of the vibrator. A divider includes a plurality of series-connected divider stages and in response to the high frequency time standard signal divides same to thereby produce a low frequency timing signal. Series-connected counters are coupled to the divider, each of the counters being adapted to produce timekeeping signals in response to the low frequency timing signal. Appropriate digital display circuitry is adapted to display actual time in response to the timekeeping signals being applied thereto.

A time adjusting circuit is coupled to a plurality of selected divider stages for supplying a presetting signal to each selected divider stage during each cycle of the low frequency timing signal to adjust the timing rate grade of the low frequency timing signal and hence improve the accuracy of the electronic wristwatch.

Accordingly, it is an object of this invention to provide an improved digital display electronic wristwatch utilizing a thickness-shear quartz crystal vibrator as a time standard.

Another object of the instant invention is to utilize a quartz crystal vibrator capable of vibrating in the MHz range for improving the accuracy of the wristwatch.

Still a further object of the instant invention is to provide a digital display electronic wristwatch utilizing a thickness-shear quartz crystal vibrator as a time standard and appropriate adjustment circuitry for obtaining the improved accuracy which inures to the thickness-shear quartz crystal vibrator.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a block circuit diagram of a digital display electronic wristwatch constructed in accordance with a preferred embodiment of the instant invention;

FIG. 4 is a perspective view of a thickness-shear quartz crystal vibrator utilized in the electronic wristwatch illustrated in FIG. 3;

FIG. 5 is a wave diagram illustrating the operation of the electronic wristwatch depicted in FIG. 3; and FIG. 6 is a circuit diagram of an adjustment circuit for adjusting the memory utilized in the electronic wristwatch depicted in FIG. 3.

DETAIL DESCRIPTION OF THE PREFERRED EMBODIMENTS

Figure 1:
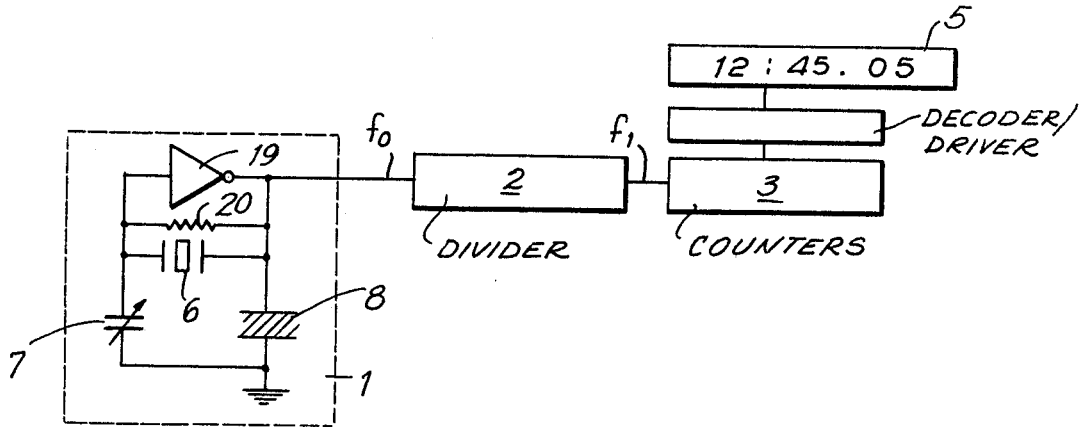
FIG. 1 PRIOR ART
FIG. 1 is a block circuit diagram of a digital display electronic wristwatch constructed in accordance with the prior art.

Reference is now made to FIG. 1, wherein a digital display electronic wristwatch constructed in accordance with the prior art is depicted. The electronic wristwatch includes an oscillator circuit 1, which oscillator circuit include a high frequency flexural mode quartz crystal vibrator 6. Flexural mode quartz crystal vibrators are adapted to vibrate at a natural frequency in the KHz range. A C-MOS inverter circuit and feedback resistor are coupled in parallel with the flexural mode vibrator 6. Additionally, a variable capacitor 7 is utilized as a tuning capacitor to tune the oscillator circuit to produce a predetermined high frequency time standard signal $f_0$. Additionally, a temperature-sensitive element such as a thermistor, of a barium titanate capacitor or varistor is utilized to compensate for changes in the temperature of the flexural mode quartz crystal vibrator 6.

The divider circuit 2 is comprised of a plurality of series-connected divider stages and in response to the high frequency time standard signal $f_O$ produces a low frequency timing signal $f_1$. Usually, the low frequency timing signal $f_1$ is a signal ideally having a one second period. Accordingly, the divider circuit has a division ratio of $\frac{1}{2}^n$ and is adapted to receive a high frequency time standard signal having a frequency $2^2$n. In an operative example, if a divider circuit is comprised of fifteen (15) series-connected binary divider stages, a high frequency time standard signal $f_0$ will have a frequency of $2^{15}$ Hz(32,768 Hz) in order to provide a one second low frequency timing signal $f_1$.

A plurality of series-connected counters 3 are coupled to receive the low frequency timing sighal $f_1$ and in response thereto apply timekeeping signals to a decoder/driver circuit 4.

A digital display 5 is coupled to the decoder/driver circuit 4 and includes seven segmented liquid crystal or LED display digits for displaying hours, minutes and seconds in the manner indicated in FIG. 1.

Figure 2:
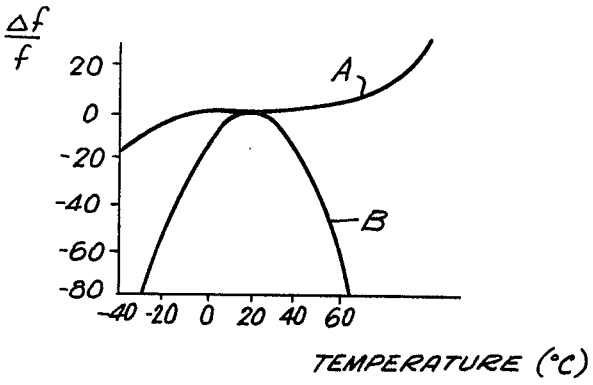
FIG. 2 is a graphical comparison of the temperature characteristics of a flexural mode quartz crystal vibrator and thickness-shear quartz crystal vibrator, respectively.

When the oscillator circuit 1 includes a flexural mode quartz crystal vibrator of the tuning fork or free-free-bar type, the high frequency time standard signal usually has a low band of several tens KHz. Nevertheless, a characteristic of such flexural mode quartz crystal vibrators is that the frequency of vibration of the vibrator is sensitive to chantes in ambient temperature. As is illustrated in FIG. 2, a flexural mode quartz crystal vibrator, illustrated as quadratic curve B, vibrates at considerably different frequencies in response to changes in ambient temperature. Accordingly, it is necessary to utilize a barium titanate capacitor or other temperature sensitive elements, in the oscillator circuit in order to stabilize the frequency of the high frequency time standard signal $f_0$ in response to changes in ambient temperature. Although such temperature sensitive elements can be effective in compensating for changes in the vibrating frequency of the flexural mode quartz crystal vibrator due to changes in temperature, other factors mitigate against obtaining a stabilized high frequency time standard signal.

For example, the temperature compensating elements have aging characteristics that alter preset corrections to the natural frequency of vibration of the flexural mode quartz crystal vibrator. Additionally during assembly, coupling the temperature sensitive element to the quartz crystal vibrator is extremely difficult. So too is the coupling of a variable trimmer capacitor 7 thereto. Nevertheless, a trimmer capacitor is necessary to tune the high frequency time standard signal to a frequency $f_0$ to be appropriately divided by the divider and produce a low frequency timing signal having the ideal period. Moreover, the trimmer capactor 7 is only capable of fine tuning the frequency of the oscillator circuit 1 and accordingly the flexural mode quartz crystal vibrator must be manufactured to vibrate at frequencies proximate to the natural frequency that the divider circuit was designed to divide down. Thus, manufacture of an accurate flexural mode quartz crystal vibrator is difficult preventing mass production of such vibrators. Moreover, considerable skill is required to remotely adjust the variable capacitor 7 to produce an accurate high frequency time standard signal. Moreover, each of these disadvantages render the attaining of extremely high accuracy in the timepiece difficult.

Also, as noted above, although digital displays have provided chronograph wristwatches, wherein resolution of one one-hundreth and one one-thousanth of a second is obtainable, when chronographic wristwatches are utilized to measure elapsed time, such chronographic wristwatches are more likely to be utilized in climates having large temperature variations. Two particular uses of stop watches to demonstrate this point are the use of such wristwatches for timing winter sports such as skiing and the like, and for timing summer sports, such as track and field events during the hot summer months. The instant invention is directed to utilizing a thickness-shear quartz crystal vibrator as a time standard in an electronic wristwatch oscillator circuit in order to overcome the above-noted deficiencies of electronic wristwatches utilizing flexural mode quartz crystal vibrators and further to provide a highly accurate timepiece thereby. Additionally, many of the disadvantages noted above are further avoided by utilizing digital circuitry for adjusting the timing rate grade to obtain a highly accurate low frequency timing signal having the ideal period.

Reference is now made to FIG. 3 wherein a digital display electronic wristwatch utilizing a thickness-shear quartz crystal vibrator is depicted, like reference numerals being utilized to denote like elements depicted in FIG. 1. The high frequency time standard signal $f_0$ produced by the oscillator circuit 1 is applied to preset divider 21 formed of a plurality of series-connected divider stages $FF_1$ through $FF_n$. The preset divider 21 produces a low frequency timing signal $f_1$, the frequency of the low frequency timing signal corresponding to $f_0$ dependon the number and type of divider stages provided, as is discussed in greater detail above with respect to FIG. 1.

The timing rate grade logical adjusting circuit includes a pulse generator 24 adapted to receive the low frequency timing signal $f_1$ and apply a pulse in response thereto each gate of a gating circuit 23 comprised of gates 91 through *gn*, each of said gates corresponding to one of divider stage $FF_1$ through $FF_n$ of presettable divider 21. A memory circuit comprised of memory stages $m_1$ through $m_n$ is provided, each memory stage being adapted to supply a presetting signal to a corresponding dividing stage $FF_1$ through $FF_n$ in presettable divider circuit 21 through corresponding gates $g_1$ through $g_n$ of gating circuit 23. Accordingly, the memory circuit 25 supplies the presetting signals, such as a reset to "0" signal or a set to "1" signal to the divider stages $FF_1$ through $FF_n$ upon the application of a pulse $f_p$ to each of the gates $g_1$ through $g_n$, comprising the gating circuit 23, by pulse generator 24. As is illustrated in FIG. 5, pulse generator 24 senses the beginning of each period of the low frequency timing signal $f_1$ and supplies a signal to gating circuit 23 to thereby open each of the gates and allow the preset signals from the memory 7 be applied to the presettable divider 21, to effect adjustment of the timing rate grade in a manner to be discussed more fully below.

Finally, correction of the time displayed by digital display 5 and hence correction of timekeeping signals produced by the series-connected counters 3 is effected by a time correction device 22 of the type well known in the art which selectively sets counters 3. Additionally, as is detailed below with respect to FIG. 6, the time correction device 22 can be utilized to write into the memory 25 the amount of adjustment required to have the low frequency timing signal have an ideal period.

Referring now to FIG. 4, the thickness-shear quartz crystal vibrator 9 utilized in the oscillator circuit 1 depicted in FIG. 3 is illustrated. The quartz crystal portion 10 is beveled or convex and the main vibrating surface 11 is rectangular shaped. Film electrodes 12 and 13 are disposed on opposed surfaces to effect excitation of the vibrator and are respectively electrically connected to the vibrator support elements 14 and 15 to render the thickness-shear quartz crystal vibrator suitable for use in a small-sized quartz crystal electronic wristwatch. Such a thickness-shear quartz crystal vibrator has a temperature-frequency characteristic illustrated by cubic curve A in FIG. 2. Accordingly, such thickness-shear quartz crystal vibrators have a substantially flat temperature-frequency characteristic over a considerable temperature range thereby avoiding the necessity of utilizing temperature compensation elements of the type needed in oscillator circuits utilizing a flexural mode quartz crystal vibrator as a time standard. Moreover, the thickness-shear quartz crystal vibrator vibrates at frequencies of about 1 MHz to 10 MHz, the high frequency of vibration thereof enabling greater accuracy to be obtained in the electronic timepiece.

As noted above, the thickness-shear vibrator 9 has a frequency of vibration in the range of one to 10 MHz and is readily mass produced. Moreover, as illustrated in FIG. 3, the oscillator circuit 1 is utilized with fixed capacitors 17 and 18 to control the phase thereof, inverter 19 and feedback resistor 20 being the same as corresponding elements in the oscillator circuit utilizing a flexural mode quartz crystal vibrator therein. By utilizing appropriate logic circuitry to adjust the timing rate grade of the low frequency timing signal, no variable trimmer capacitor is needed and further in view of the stable temperature characteristic of the thickness-shear quartz crystal vibrator over a wide range of temperatures, the thermister element need not be utilized in the oscillator circuit. Accordingly, the capacitors 17 and 18 can be included in the same integrated circuit chip that the inverter 19 and resistor 20 are formed, thereby improving the reliability and simplicity of the oscillator circuit.

The timing rate grade of the low frequency timing signal is adjusted as follows: The signal supplied by memory stages $m_1$ through $m_n$ are utilized to set the divider stages $FF_1$ through $FF_n$ to the proper state. Accordingly if the timekeeping signal $f_n$ is retarded and therefore provides a timekeeping signal having a period which is longer than the actual time desired, the amount of error $\Delta t$ for each period and the mode of counting either subtraction or addition is determined. The memory circuit then is set to apply a presetting signal to thereby preset the divider stages once each period of the low frequency timing signal to thereby provide an adjusted low frequency timing signal corresponding to an ideal time period.

In the embodiment illustrated in FIG. 3, since the preset divider 21 is a count-down divider, i.e., a divider that counts in a subtraction mode whereby flip-flops $FF_1$ through $FF_n$ begin each period of the timekeeping signal at 1, 1, . . . , 1 and end each period at 0, 0, . . . , 0, countdown is effected by subtracting one pulse (1, 0, 0, . . . , 0) from the preset stage of the preset divider 21 at the beginning of each period of the high frequency signal $f_1$ until each of the flip-flops $FF_1$ through $FF_n$ is at a "0" binary state and the count of the preset divider 21 is zero (0, 0, . . . , 0). When each of the flip-flops $FF_1$ through $FF_n$ are set to "0", an output signal $f_1$ indicating the beginning of a new period of the preset divider 21 is applied to pulse generator 24, which pulse generator in response to detecting the rising leading edge of the low frequency timing signal $f_1$ applies a gating signal $f_p$ to each of the gate circuits $g_1$ through $g_n$ comprising gating circuit 23 to thereby apply to each of the flip-flops $FF_1$ through $FF_n$ the respective inputs of memory stages $m_1$ through $m_n$ and thereby pre-set the preset divider 21, and thereby adjust the timing rate grade of the low frequency timing signal $f_1$ in response to the high frequency time standard signal $f_0$ being applied thereto.

It is noted that since the pre-set divider 21 has a division ratio of $\frac{1}{2}^n$, when the natural frequency of oscillator circuit 1 is $2^n$ HZ, the low frequency time signal $f_1$ is intended to ideally be a one-second signal. Accordingly, if the high frequency time standard signal $f_0$ does in fact have a stable frquency of $2^2$ HZ, the data stored in the memory 25 ($m_1$, $m_2$. . . , $m_n$) is all ones (1, 1, . . . , 1) at each stage of the memory. Moreover, when the stabilized frequency of the quartz crystal oscillator circuit $f_0$ is below $2^n$ Hz (as illustrated by the wave form depicted in FIG. 5) the period of $f_1$ becomes greater than one second by $\Delta t$ seconds, and the low frequency timing signal $f_1$ therefore has a period of $1 + \Delta t$ seconds. Accordingly, the binary code number written into memory stages $m_1$ through $m_n$ is that number which will reduce the period of the low frequency timing signal $f_1$ by $\Delta T$.

For example, if the period of the low frequency timing signal $f_1$ is greater than one second, by a time period equal to two pulses of the high frequency time standard signal $f_0$, each of the stages of the memory 25 ($m_1$, $m_2$, $m_3$, $m_4$, . . . , $m_n$) are set to an approximate binary code (1, 0, 1, 1, . . . , 1,) to reduce the period of the low frequency timing signal $f_1$.

Reference is now made to FIG. 6 wherein circuitry for writing a binary code into the memory 25 is illustrated. The difference between the actual frequency of the high frequency time standard signal $f_0$ and $2^n$ Hz determines the binary data to be written into the memory 25, the high frequency time standard signal $f_0$ being selected to have a frequency below $2^n$ Hz. As detailed in greater specificity below, the series-connected counters 3 are utilized to produce binary data, which data is displayed by digital display 5 and is written into the memory 25.

An AND gate 27 is disposed intermediate the preset divider 21 and series-connected counters 3 and includes as a first input the low frequency timing signal $f_1$ and as a second input an inverted frequency rate grade adjustment signal $f_m$. Additionally, frequency rate grade adjustment signal $f_m$ is applied to the T terminal of each of the memory stages $m_1$ through $m_n$, said memory stages being formed, by way of example, of D-type flip flops. Accordingly, when adjustment of the frequency rate grade is required, the frequency rate grade adjustment signal $f_m$ is applied to AND gate 27 to inhibit the application of the low frequency timing signal $f_1$ to the series-connected counters 3. Also, the application of the time rate grade adjustment signal to the T terminal of the memory stages $m_1$ through $m_n$ permits information to be written into the D terminal thereof. Each of said memory stages is electrically connected to an output terminal of a corresponding one of counters 3 (or of a stage of said counters) so that the setting of the counters is read into the corresponding memory stages when the frequency rate grade adjustment signal $f_m$ is applied to the T terminal of said memory stages. Accordingly, the time correction device 22 is utilized to adjust the count of the series-connected counters 3 after regular time counting is inhibited by signal $f_m$, which count is displayed by the digital display 5, and is written into the respective memory stages $m_1$ through $m_n$ by the frequency rate grade adjustment signal $f_m$. Accordingly, the time correction device 22 in addition to correcting the time displayed by the electronic wristwatch is also utilized to determine the binary data to be written into the memory 25. Instructions can be provided so that each predetermined setting of counters 3 corresponds to a correction time $\Delta t$ and to a corresponding setting of memory 25.

It is noted that the time displayed by the digital display 5 is readily written into the memory 25 by corresponding same to the binary data in the memory 25 at an approximate ratio such as one to one. Moreover, although the binary data stored in memory 25 is lost when the power source energizing the electronic wristwatch ceases to function, or additionally the binary data in the memory is lost when the battery is changed, the binary data is readily re-written into the memory by the instant invention. It is further noted that the degree of adjustment of the timing rate grade of the low frequency timing signal is inversely proportional to the magnitude of the resonant frequency of the time standard of the oscillator circuit so that the greater the magnitude of the high frequency time standard signal, the more accurate the adjustment of the timepiece. Thus, by utilizing a thickness-shear quartz crystal vibrator capable of oscillating in the MHz range, in accordance with the instant invention an extremely accurate timing rate grade adjustment of 0.09 inches to 0.01 inches, on a daily basis, can be achieved.

By utilizing a timing rate grade adjustment in accordance with the instant invention, the resonant frequency of the quartz crystal vibrator 9 can be arbitrarily selected at any frequency below $2^n$Hz. Accordingly, since it is not necessary to manufacture a quartz crystal vibrator that operates within a few Hz of the required natural frequency, the cost of manufacturing such quartz crystal vibrators is considerably lessened, and a highly stabilized high frequency time standard signal is produced by the oscillator circuit.

By utilizing a thickness-shear quartz crystal vibrator having a resonant frequency in the one to 10 M Hz range, the frequency-temperature characteristic is stable over a wide temperature range. The stable frequency-temperature characteristic permits the trimmer capactor to be eliminated in the oscillator circuit, thereby lessening the instability of the oscillator circuit caused by aging of the trimmer capacitor. Moreover, the stable frequency-temperature characteristic permits the use of quartz crystal wristwatches as a chronograph in varying environments without any loss in timekeeping accuracy, and is particularly suitable for obtaining the extremely high resolution of one-hundreth and one-thousanth seconds made available by utilizing digital displays in electronic timepieces.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic wristwatch comprising in combination oscillator means, said oscillator means including a quartz crystal time standard said quartz crystal time standard having a predetermined resonant frequency, said oscillator means being adapted to produce a high frequency time standard signal having a frequency equal to said predetermined resonant frequency of said quartz crystal time standard, divider means including a plurality of series-connected divider stages for receiving said high frequency time standard signal and dividing same to produce a low frequency timing signal, a plurality of series-connected counters for receiving said low frequency timing signal, said signal being applied thereto being adapted to produce timekeeping signals representative of actual time, digital display means for receiving said timekeeping signals and in response thereto displaying the time represented thereby, low frequency timing signal adjusting means coupled by output means to each divider stage, said adjusting means including a memory means adapted to store a frequency rate grade count therein, said adjustment means being adapted to adjust the frequency rate grade of said low frequency timing signal to a desired frequency by an amount equal to said frequency rate grade count stored in said memory, an inhibit gate disposed intermediate the series-connected divider stages and series-connected counters for inhibiting the application of the low frequency timing signal to the series-connected counters, timing rate grade adjustment means for applying to a further input of said inhibit gate means and said memory means a timing rate grade adjustment signal for inhibiting the application of said low frequency timing signal to said series-connected counters, correction means coupled to said series-connected counters for selectively adjusting the count thereof, and means coupling said memory means to said counters for selectively setting said memory means to the count of said counters producing timekeeping signals, in response to said counters being adjusted by said correction means when said timing rate grade signal is applied to said memory means.

2. An electronic timepiece as claimed in claim 1, wherein said adjusting means is responsive to said low frequency timing signal for supplying presetting signals to each of said series-connected divider stages through said output means once for each period of low-frequency timing signal to preset the count of each of said series-connected divider stages and thereby adjust the frequency rate grade and hence the period of the low-frequency timing signal by an amount equal to said frequency rate grade count stored in said memory means.

3. An electronic timepiece as claimed in claim 1, wherein said means for applying said timing rate grade signal to said inhibit gate means is adapted to apply said timing rate grade adjustment signal to memory means to thereby write-in to said memory means the count of said series-connected counters coupled thereto.

4. An electronic timepiece as claimed in claim 2, wherein said output means includes a gating circuit coupled to said memory means and to each of said series-connected binary divider stages.

5. An electronic timepiece as claimed in claim 4 wherein said low frequency timing signal adjusting means further includes a pulse generating circuit for receiving said low frequency timing signal.

6. An electronic timepiece as claimed in claim 4, wherein said memory means include a plurality of memory stages, one memory stage being provided for each series-connected divider stage, each said memory stage being adapted to preset said divider stage associated therewith to a predetermined binary state once during each period of the low frequency timing signal.

7. In an electronic timepiece including an oscillator circuit producing a high frequency time standard signal, divider means including a plurality of series-connected divider stages for receiving said high frequency time standard signal and dividing same to produce a low frequency timing signal for a frequency having a period which is different than the ideal time period sough to be produced thereby, the improvement comprising a plurality of series-connected counters for receiving said low frequency timing signal and in response thereto producing binary data signals representative of the count thereof, counter adjustment means coupled to said counters for changing the count thereof, display means coupled to each said series-connected counters for displaying the count of said counters in response to said binary data signals being applied thereto, low frequency signal adjusting means coupled by output means to each of said divider stages, said adjusting means including memory means, said adjusting means being responsive to said low frequency timing signal for supplying presetting signals to said divider stages through said output means, said presetting signal being stored by said memory means and applied to the respective divider stages once for each period of said low frequency timing signal to preset the count of each of said divider stages and thereby adjust the frequency of the low frequency timing signal, and memory adjustment means for selectively coupling said memory means to said counters and inhibiting the application of said low frequency timing signal to said counters, said memory means being coupled to said counters to receive said binary data signals and effect a selective setting of the memory means to the count of said counters in response to the setting of said counters by said counter adjustment means.

8. An electronic timepiece as claimed in claim 7, wherein said memory adjustment means includes inhibit means disposed intermediate said series connected divider stages and said plurality of series-connected counters, said inhibit means being adapted to receive an inhibit signal and in response thereto to inhibit application of said low frequency timing signal to said series-connected counters.

9. An electronic timepiece as claimed in claim 8, wherein said memory means are adapted to have said binary data signals of said counters written therein in response to said inhibit signal being applied to said memory means.

* * * * *